US012291378B2

(12) United States Patent
Zhang et al.

(10) Patent No.: US 12,291,378 B2
(45) Date of Patent: May 6, 2025

(54) STORAGE TANK

(71) Applicant: GENICOOK PRODUCT, LLC, Garland, TX (US)

(72) Inventors: Jianzhong Zhang, Handan (CN); Xiaojia Liu, Handan (CN)

(73) Assignee: GENICOOK PRODUCT, LLC, Garland, TX (US)

( * ) Notice: Subject to any disclaimer, the term of this patent is extended or adjusted under 35 U.S.C. 154(b) by 19 days.

(21) Appl. No.: 18/346,864

(22) Filed: Jul. 5, 2023

(65) Prior Publication Data

US 2023/0348153 A1 Nov. 2, 2023

(30) Foreign Application Priority Data

Feb. 20, 2023 (CN) ..... 202320252976.2

(51) Int. Cl.

| | |
|---|---|
| ***B65D 43/26*** | (2006.01) |
| ***B65D 39/12*** | (2006.01) |
| ***B65D 43/02*** | (2006.01) |
| ***B65D 53/02*** | (2006.01) |

(52) U.S. Cl.

CPC ..... *B65D 43/26* (2013.01); *B65D 39/12* (2013.01); *B65D 43/022* (2013.01); *B65D 53/02* (2013.01); *B65D 2543/00092* (2013.01); *B65D 2543/00527* (2013.01); *B65D 2543/00564* (2013.01); *B65D 2543/00925* (2013.01); *B65D 2543/00972* (2013.01)

(58) Field of Classification Search

CPC ..... B65D 43/26; B65D 43/022; B65D 53/02; B65D 2543/00092; B65D 2543/00527; B65D 2543/00564; B65D 2543/00925; B65D 2543/00972; B65D 39/12

See application file for complete search history.

(56) References Cited

U.S. PATENT DOCUMENTS

| | | | | |
|---|---|---|---|---|
| 4,942,970 | A * | 7/1990 | Jay | B65D 39/12 215/358 |
| 6,170,690 | B1 * | 1/2001 | Hosoi | H01L 21/67376 206/711 |
| 7,513,381 | B2 * | 4/2009 | Heng | B65D 51/1683 220/806 |
| 11,312,548 | B2 * | 4/2022 | Silsby | A47J 41/0022 |
| 2005/0279746 | A1 * | 12/2005 | Hsu | B65D 39/12 220/234 |

(Continued)

*Primary Examiner* — James N Smalley

(74) *Attorney, Agent, or Firm* — Hemisphere Law, PLLC; Zhigang Ma

(57) ABSTRACT

The present invention provides a storage tank which comprises a tank body and a sealing cover. A top of the tank body is provided with a tank mouth; the sealing cover can seal the tank mouth; the sealing cover comprises a main cover, a cover plate, a sealing ring, an annular extrusion part and a sealing switch; a top of the main cover is provided with an accommodating groove; the cover plate is covered on the accommodating groove; an edge of the cover plate is covered on the tank mouth; the sealing ring is sleeved and fixed on the outer circumference of the main cover; the annular extrusion part is slidably sleeved on the main cover below the sealing ring ; the sealing switch is located in the accommodating groove. The storage tank has good sealing effect, simple operation and convenient use.

8 Claims, 7 Drawing Sheets

(56) References Cited

U.S. PATENT DOCUMENTS

| | | | | |
|---|---|---|---|---|
| 2010/0282748 | A1* | 11/2010 | Lu | B65D 43/022<br>220/260 |
| 2012/0006832 | A1 | 1/2012 | Krause et al. | |
| 2013/0001224 | A1 | 1/2013 | Payne et al. | |
| 2013/0326853 | A1 | 12/2013 | Allen et al. | |

* cited by examiner

STORAGE TANK

TECHNICAL FIELD

The present invention relates to a storage tank, and belongs to the technical field of article storage devices.

BACKGROUND

At present, a sealing cover and a body of the storage tank are generally connected by threads, but it is complicated to open and close the cover for thread connection, which requires both hands to hold the sealing cover and the body respectively.

CN 104085582 B discloses a storage tank which comprises a tank body having an upper opening. The upper part of the tank body is detachably provided with an upper cover capable of closing the upper opening. The bottom of the upper cover is provided with an extension part capable of extending into the tank body, and the extension part is provided with a groove capable of being clamped with a bulge on the inner circumferential wall of the upper opening of the tank body.

Although it is more convenient to close the tank body for clamping, it is still necessary to use both hands to open the sealing cover, and with the increase of the number of use, the wear of the clamping contact may also be increased, thereby affecting the use and sealing effects.

SUMMARY

The technical problem to be solved by the present invention is to provide a storage tank, which has good sealing effect, simple operation and convenient use.

The present invention solves the above technical problems by the following technical solution: a storage tank comprises a tank body and a sealing cover; a top of the tank body is provided with a tank mouth; the sealing cover can seal the tank mouth; the sealing cover comprises a main cover, a cover plate, a sealing ring, an annular extrusion part and a sealing switch; a top of the main cover is provided with an accommodating groove; the cover plate is covered on the accommodating groove and is provided with operation ports corresponding to the sealing switch; an edge of the cover plate is covered on the tank mouth; a sealable annular gap is formed between an outer circumference of the main cover and an inner wall of the tank body; the sealing ring is sleeved and fixed on the outer circumference of the main cover; the annular extrusion part is slidably sleeved on the main cover below the sealing ring to extrude or release the sealing ring to change a shape for opening or sealing the annular gap; the sealing switch is located in the accommodating groove; an upper end of the sealing switch is a driving end and corresponds to the operation ports, and a lower end is an installing end and is fixedly connected with the annular extrusion part.

The present invention has the beneficial effects that: the sealing cover is covered at the tank mouth; the main cover extends into the tank body and forms the annular gap with the inner wall; the sealing ring is sleeved and fixed on the outer circumferential side of the main cover and extruded on the inner wall of the tank body to seal the annular gap; the sealing switch is extruded; the annular extrusion part can be driven to slide along the axial direction of the main cover to extrude the sealing ring through a lever principle; the sealing ring is tightened away from the inner wall of the tank body and then the sealing cover can be removed, to open the storage tank; and the sealing effect is good, the operation is simple and the use is convenient.

On the basis of the above technical solution, the present invention can also be improved as follows.

Further, the sealing switch comprises a guide column, a compression spring, a lifting frame, two switch keys and a connecting column; the guide column is fixed at the bottom of the cover plate along a sliding direction of the annular extrusion part; the lifting frame is slidably connected to the guide column; and the compression spring is sleeved on the guide column, and both ends are fixedly connected with the bottom of the cover plate and the lifting frame respectively;

The two switch keys are symmetrically and rotatably connected to the main cover and have a lifting gap therebetween for accommodating the lifting frame; two operation ports are arranged, and the driving ends of the two switch keys correspond to the operation ports and connecting ends are movably connected with the lifting frame; and the upper end of the connecting column is fixed on the lifting frame;

The bottom of the accommodating groove is provided with a perforated hole corresponding to the connecting column, the lower end of the connecting column is the installing end, and the installing end penetrates through the perforated hole and is fixedly connected with the annular extrusion part.

Beneficial effects of the above further solution are as follows: two fingers penetrate through the operation ports and knead the driving ends of the two switch keys; the two switch keys rotate to raise the connecting ends; the connecting ends drive the lifting frame to slide upward along the guide column; the connecting column rises with the lifting frame; the lower end of the connecting column is fixedly connected with the annular extrusion part to drive the annular extrusion part to slide upward; the annular extrusion part extrudes the sealing ring and narrows the diameter of the sealing ring so that the outermost layer of the sealing ring is away from the inner wall of the tank body; the annular gap is opened; two fingers act upwards to take off the sealing cover to open the storage tank; and the compression spring always has the tendency to keep the lifting frame away from the cover plate, that is, has the tendency to always slide the lifting frame down along the guide column. When the fingers release the two switch keys, under the action of the elastic force of the compression spring, the switch keys are reset, and the annular extrusion part slides downward to release the sealing ring which seals the annular gap.

Further, the annular extrusion part comprises an extrusion ring and a connecting frame; the connecting frame is fixed on the inner wall of the extrusion ring; the lower end of the connecting column is fixedly connected with the connecting frame; the bottom lower end surface of the main cover is provided with a groove for the connecting frame to slide up and down; and the extrusion ring is slidably sleeved on the main cover.

Beneficial effects of the above further solution are as follows: the connecting column drives the connecting frame to move up and down, and the connecting frame is slidably connected into the groove so that the extrusion ring can be slidably connected to the main cover to extrude and release the sealing ring.

Further, the connecting frame is an I-shaped frame, and the groove is correspondingly matched with the I-shaped frame.

Further, the lifting frame comprises a lifting frame body and a connecting piece; the connecting piece is a disc; the disc is fixed on the lifting frame body; the connecting column is coaxially fixed at the bottom of the disc; the guide column and the connecting column are coaxially arranged; the disc and the connecting column are provided with guide holes corresponding to the guide column; the guide column is slidably connected into the guide holes; and the connecting ends of the switch keys are movably connected with the lifting frame body.

Beneficial effects of the above further solution are as follows: the disc conveniently provides a smooth connection surface for the compression spring, and the connecting column is slidably connected to the guide column through the guide holes to prevent the lifting frame body from deviating; and the disc, the guide column and the connecting column are coaxially arranged to prevent the extrusion ring from sliding and deviating, so as to ensure that the extrusion ring has the same deformation on the peripheral extrusion of the sealing ring.

Further, the sealing switch further comprises a sealing gasket, the sealing gasket is provided with an installing hole corresponding to the connecting column, and the sealing gasket is sleeved on the connecting column for sealing the perforated hole.

Beneficial effects of the above further solution are as follows: the sealing gasket is installed on the connecting column and can be raised or lowered with the connecting column to open or seal the perforated hole, and under the action of the compression spring, the disc can press the sealing gasket against the top edge of the perforated hole to seal the perforated hole.

Further, the sealing switch further comprises four connecting plates; the four connecting plates are fixed at the bottom of the cover plate, located on both sides of the two switch keys, and arranged symmetrically; connection bulges are symmetrically fixed on two side surfaces of the two switch keys; the four connecting plates are provided with connecting holes; the four connecting bulges are correspondingly rotatably connected to the four connecting holes; and the driving ends of the two switch keys are kneaded to rotate with the connecting bulges as axes to drive the connecting ends to rise and then drive the lifting frame body to rise.

Beneficial effects of the above further solution are as follows: the two switch keys are rotatably connected to the connecting plates through the connecting bulges; the driving ends of the switch keys are kneaded, and the two switch keys rotate with the connecting bulges as the axes; according to the lever principle, the connecting ends of the switch keys make upward arc movement; because the connecting ends and the lifting frame body are movably connected, the transverse movement in the arc movement can be offset and the lifting frame body is driven only to move in a longitudinal direction.

Further, the connecting end of each of the switch keys is symmetrically fixed with two sliding bulges perpendicular to the axial direction of the main cover, the lifting frame body is provided with four chutes corresponding to the four sliding bulges on the frame body, and the four sliding bulges are correspondingly slidably connected in the four chutes.

Beneficial effects of the above further solution are as follows: the sliding bulges can slide in the chutes along a transverse direction, which can offset the transverse movement of the sliding bulges in the arc movement without hindering the movement of the sliding bulges; and the longitudinal movement of the sliding bulges in the arc movement can extrude the inner walls of the chutes and drive the lifting frame body to move along the longitudinal direction.

Further, an annular groove is arranged on the circumferential side of the main cover, the sealing ring is sleeved and fixed on the annular groove, and the outer circumferential side of the sealing ring can extend from the annular groove to seal the annular gap.

Beneficial effect of the above further solution is as follows: the annular groove can conveniently fix the sealing ring.

A list of components represented by legends in the figures is as follows:

1-tank body; 2-sealing cover; 21-cover plate; 211-operation port; 22-main cover; 221-accommodating groove; 222-groove; 223-annular groove; 23-sealing ring; 24-annular extrusion part; 241-extrusion ring; 242-connecting frame; 25-sealing switch; 251-lifting frame; 252-switch key; 253-compression spring; 254-guide column; 255-connecting column; 256-connecting piece; 257-sealing gasket; 258-connecting plate; 259-lifting frame body; 3-annular gap; 4-lifting gap; 5-perforated hole; 6-guide hole; 7-installing hole; 8-connecting bulge; 9-connecting hole; 10-sliding bulge; 11-chute.

DETAILED DESCRIPTION

The principles and features of the present invention will be described below in combination with drawings. Described examples are only used for explaining the present invention, but are not intended to limit the scope of the present invention.

The purpose of the present invention is to provide a storage tank, to solve the problems in the prior art, and the storage tank has good sealing effect, simple operation and convenient use.

To make the above purpose, features and advantages of the present invention more clear and understandable, the present invention will be further described below in detail in combination with the drawings and specific embodiments.

Figure 1:
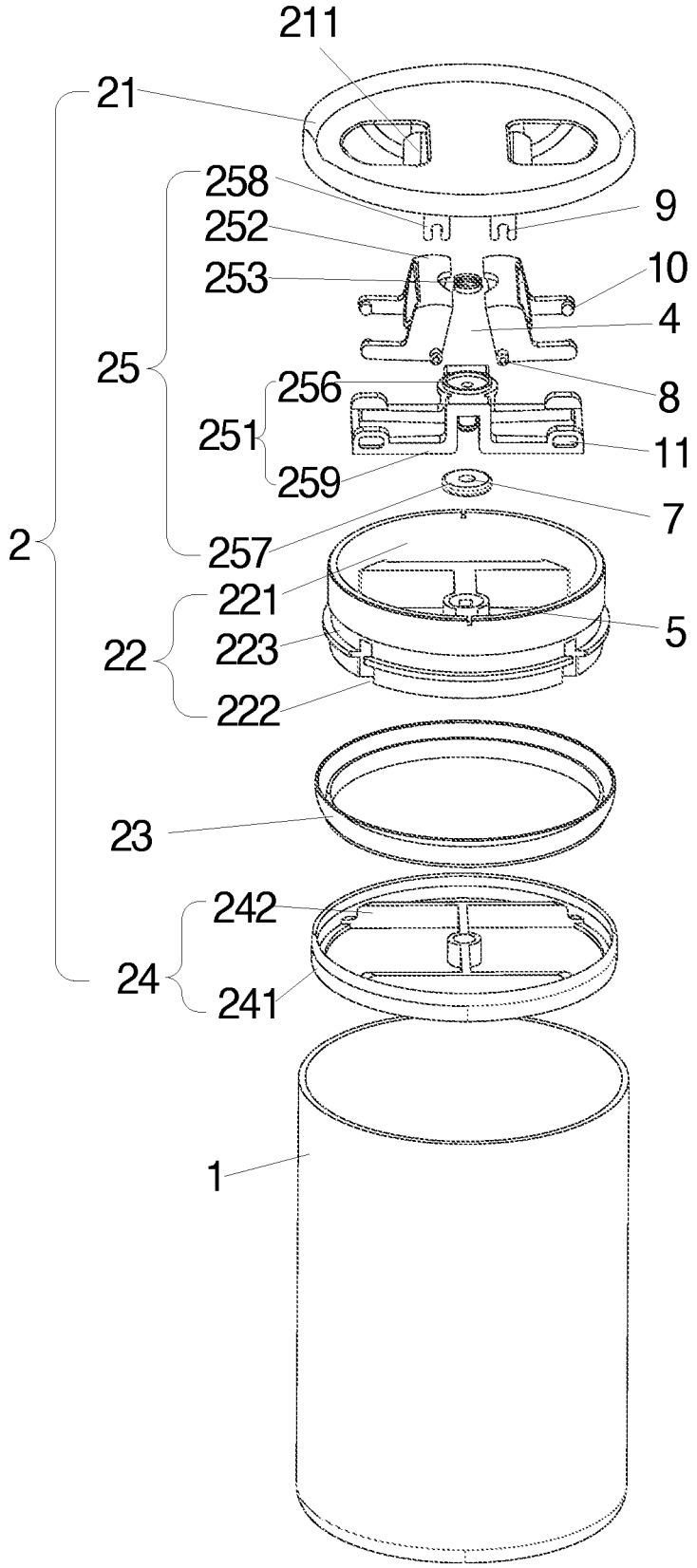
FIG. 1 is an exploded view of a storage tank provided by the present invention.
Figure 2:
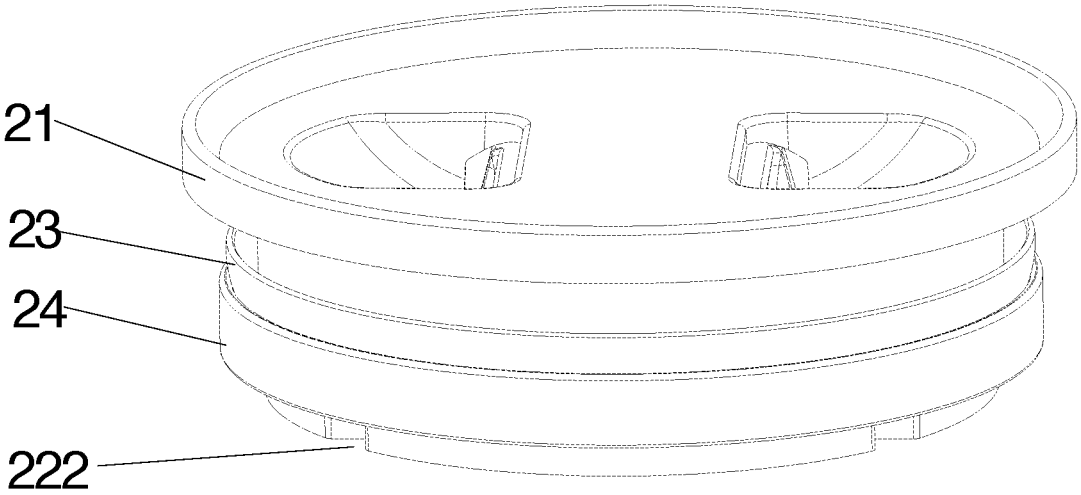
FIG. 2 is a structural schematic diagram of an open state of a sealing cover in a storage tank provided by the present invention.
Figure 3:
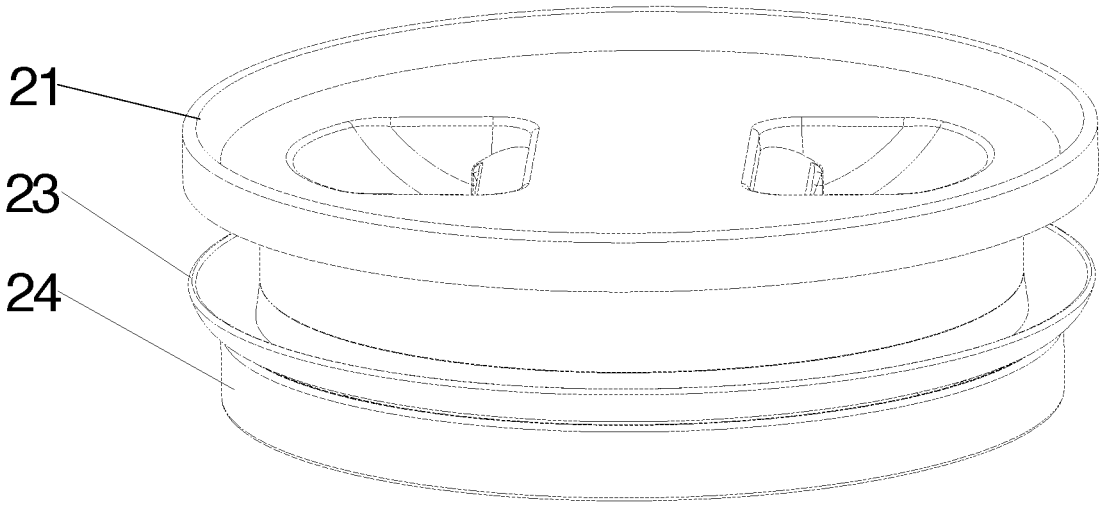
FIG. 3 is a structural schematic diagram of a sealed state of a sealing cover in a storage tank provided by the present invention.
Figure 4:
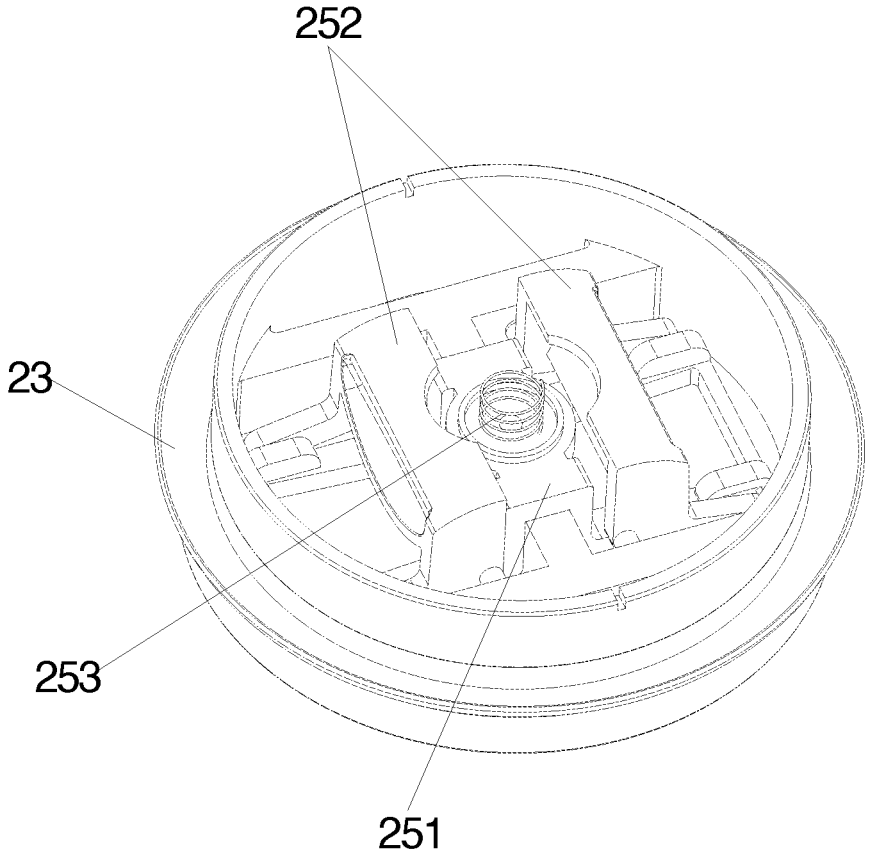
FIG. 4 is an internal structural schematic diagram of a sealing cover in a storage tank provided by the present invention.
Figure 5:
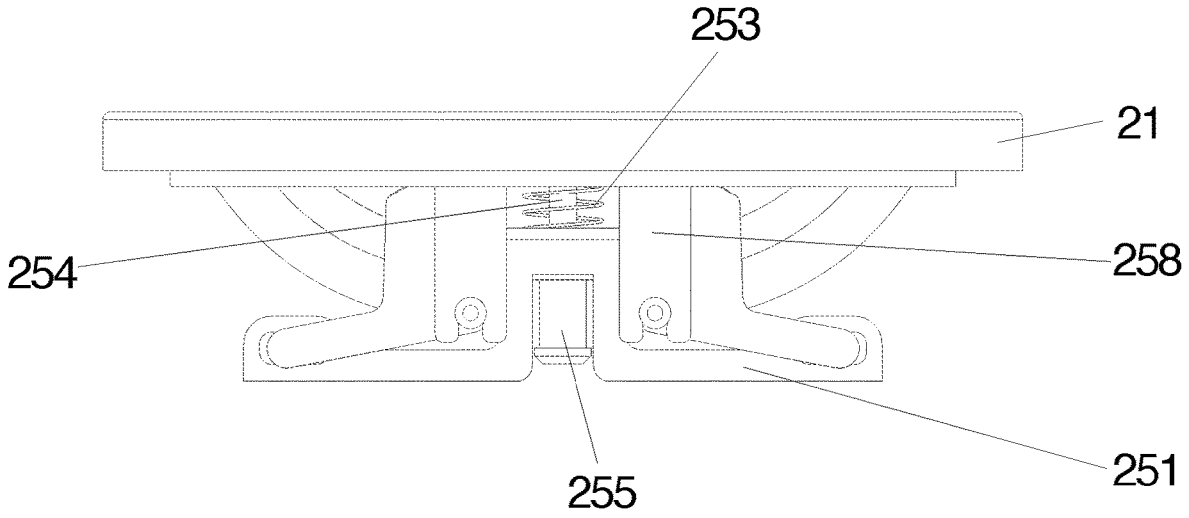
FIG. 5 is a main view of a sealing cover without a main cover in a storage tank provided by the present invention.
Figure 6:
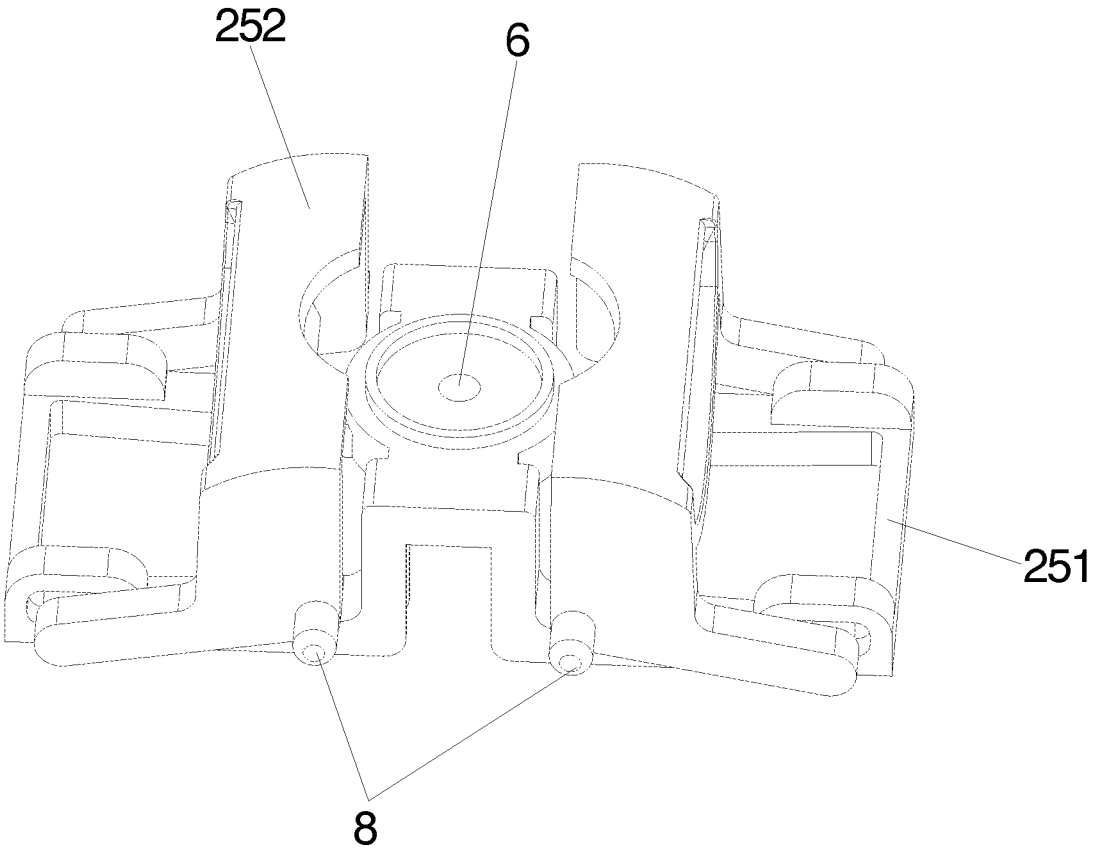
FIG. 6 is an installation diagram of switch keys and a lifting frame in a storage tank provided by the present invention.
Figure 7:
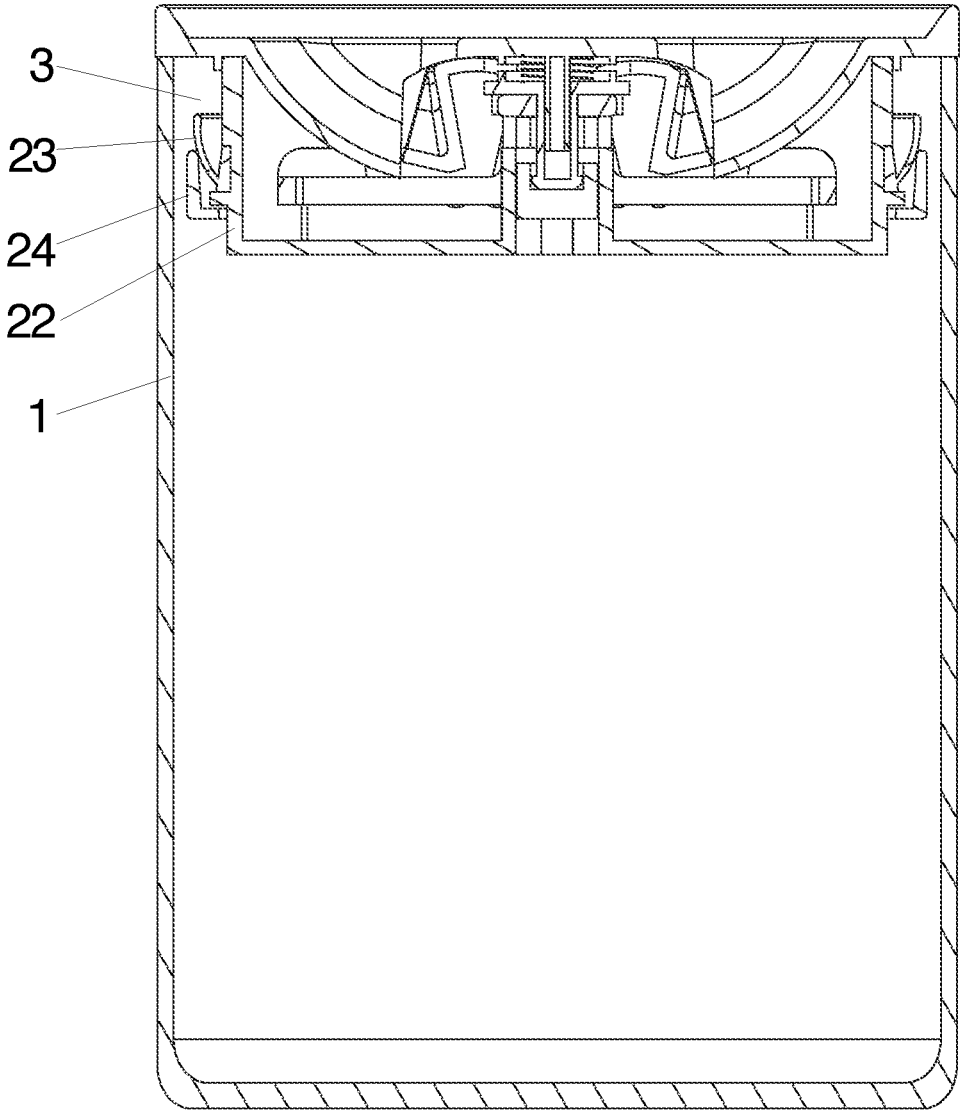
FIG. 7 is a sectional view of a storage tank provided by the present invention.

The present invention provides a storage tank, as shown in FIG. 1 to FIG. 1, which comprises a tank body 1 and a sealing cover 2; a top of the tank body 1 is provided with a tank mouth; the sealing cover 2 can seal the tank mouth; the sealing cover 2 comprises a main cover 22, a cover plate 21, a sealing ring 23, an annular extrusion part 24 and a sealing switch 25; a top of the main cover 22 is provided with an accommodating groove 221; the cover plate 21 is covered on the accommodating groove 221 and is provided with operation ports 211 corresponding to the sealing switch 25; an edge of the cover plate 21 is covered on the tank mouth; a sealable annular gap 3 is formed between an outer circumference of the main cover 22 and an inner wall of the tank body 1; the sealing ring 23 is sleeved and fixed on the outer circumference of the main cover 22; the annular extrusion part 24 is slidably sleeved on the main cover 22 below the sealing ring 23 to extrude or release the sealing ring 23 to change a shape for opening or sealing the annular gap 3; the sealing switch 25 is located in the accommodating groove 221; an upper end of the sealing switch is a driving end and corresponds to the operation ports 211, and a lower end is an installing end and is fixedly connected with the annular extrusion part 24.

The present invention provides a storage tank. The sealing cover 2 is covered at the tank mouth; the main cover 22 extends into the tank body 1 and forms the annular gap 3 with the inner wall; the sealing ring 23 is sleeved and fixed on the outer circumferential side of the main cover 22 and extruded on the inner wall of the tank body 1 to seal the annular gap 3; the sealing switch 25 is extruded; the annular extrusion part 24 can be driven to slide along the axial direction of the main cover to extrude the sealing ring 23 through a lever principle; the sealing ring 23 is tightened away from the inner wall of the tank body 1 and then the sealing cover 2 can be removed, to open the storage tank; and the sealing effect is good, the operation is simple and the use is convenient.

In one specific embodiment of the present invention, the sealing switch 25 comprises a guide column 254, a compression spring 253, a lifting frame 251, two switch keys 252 and a connecting column 255; the guide column 254 is fixed at the bottom of the cover plate 21 along a sliding direction of the annular extrusion part 24; the lifting frame 251 is slidably connected to the guide column 254; and the compression spring 253 is sleeved on the guide column 254, and both ends are fixedly connected with the bottom of the cover plate 21 and the lifting frame 251 respectively. The two switch keys 252 are symmetrically and rotatably connected to the main cover 22 and have a lifting gap 4 therebetween for accommodating the lifting frame 251; two operation ports 211 are arranged, and the driving ends of the two switch keys 252 correspond to the operation ports 211 and connecting ends are movably connected with the lifting frame 251; and the upper end of the connecting column 255 is fixed on the lifting frame 251. The bottom of the accommodating groove 221 is provided with a perforated hole 5 corresponding to the connecting column 255, the lower end of the connecting column 255 is the installing end, and the installing end penetrates through the perforated hole 5 and is fixedly connected with the annular extrusion part 24.

In one specific embodiment of the present invention, two fingers penetrate through the operation ports 211 and knead the driving ends of the two switch keys 252; the two switch keys 252 rotate to raise the connecting ends; the connecting ends drive the lifting frame 251 to slide upward along the guide column 254; the connecting column 255 rises with the lifting frame 251; the lower end of the connecting column 255 is fixedly connected with the annular extrusion part 24 to drive the annular extrusion part 24 to slide upward; the annular extrusion part 24 extrudes the sealing ring 23 and narrows the diameter of the sealing ring 23 so that the outermost layer of the sealing ring is away from the inner wall of the tank body 1; the annular gap 3 is opened; two fingers act upwards to take off the sealing cover 2 to open the storage tank; and the compression spring 253 always has the tendency to keep the lifting frame 251 away from the cover plate 21, that is, has the tendency to always slide the lifting frame 251 down along the guide column 254. When the fingers release the two switch keys 252, under the action of the elastic force of the compression spring 253, the switch keys 252 are reset, and the annular extrusion part 24 slides downward to release the sealing ring 23 which seals the annular gap 3.

In one specific embodiment of the present invention, the annular extrusion part 24 comprises an extrusion ring 241 and a connecting frame 242; the connecting frame 242 is fixed on the inner wall of the extrusion ring 241; the lower end of the connecting column 255 is fixedly connected with the connecting frame 242; the bottom lower end surface of the main cover 22 is provided with a groove 222 for the connecting frame 242 to slide up and down; and the extrusion ring 241 is slidably sleeved on the main cover 22.

The connecting column 255 drives the connecting frame 242 to move up and down, and the connecting frame 242 is slidably connected into the groove 222 so that the extrusion ring 241 can be slidably connected to the main cover 22 to extrude and release the sealing ring 23.

In one specific embodiment of the present invention, the connecting frame 242 is an I-shaped frame, and the groove 222 is correspondingly matched with the I-shaped frame.

In one specific embodiment of the present invention, the lifting frame 251 comprises a lifting frame body 259 and a connecting piece 256; the connecting piece 256 is a disc; the disc is fixed on the lifting frame body 259; the connecting column 255 is coaxially fixed at the bottom of the disc; the guide column 254 and the connecting column 255 are coaxially arranged; the disc and the connecting column 255 are provided with guide holes 6 corresponding to the guide column 254; the guide column 254 is slidably connected into the guide holes 6; and the connecting ends of the switch keys 252 are movably connected with the lifting frame body 259.

The disc conveniently provides a smooth connection surface for the compression spring 253, and the connecting column 255 is slidably connected to the guide column 254 through the guide holes 6 to prevent the lifting frame body 259 from deviating; and the disc, the guide column 254 and the connecting column 255 are coaxially arranged to prevent the extrusion ring 241 from sliding and deviating, so as to ensure that the extrusion ring 241 has the same deformation on the peripheral extrusion of the sealing ring 23.

Preferably, the lifting frame body 259 comprises two zigzag brackets and two cross bars, the two zigzag brackets are arranged in parallel, the two cross bars are symmetrically connected at both ends of the two zigzag brackets, and the disc is fixed in the middle top position of the two zigzag brackets.

Preferably, both sides of the bottom of the accommodating groove 221 are provided with installing grooves; the zigzag brackets can be assumed to be on groove walls between the two installing grooves, and both sides are embedded in the installing grooves to save more space and reduce the volume.

In one specific embodiment of the present invention, the sealing switch 25 further comprises a sealing gasket 257, the sealing gasket 257 is provided with an installing hole 7 corresponding to the connecting column 255, and the sealing gasket 257 is sleeved on the connecting column 255 for sealing the perforated hole 5.

The sealing gasket 257 is installed on the connecting column 255 and can be raised or lowered with the connecting column 255 to open or seal the perforated hole 5, and under the action of the compression spring 253, the disc can press the sealing gasket 257 against the top edge of the perforated hole 5 to seal the perforated hole.

In one specific embodiment of the present invention, the sealing switch further comprises four connecting plates 258; the four connecting plates 258 are fixed at the bottom of the cover plate 21, located on both sides of the two switch keys 252, and arranged symmetrically; connection bulges 8 are symmetrically fixed on two side surfaces of the two switch keys 252; the four connecting plates 258 are provided with connecting holes 9; the four connecting bulges 8 are correspondingly rotatably connected to the four connecting holes 9; and the driving ends of the two switch keys 252 are kneaded to rotate with the connecting bulges 8 as axes to drive the connecting ends to rise and then drive the lifting frame body 259 to rise.

The two switch keys 252 are rotatably connected to the connecting plates 258 through the connecting bulges 8; the driving ends of the switch keys 252 are kneaded, and the two switch keys 252 rotate with the connecting bulges 8 as the axes; according to the lever principle, the connecting ends of the switch keys 252 make upward arc movement; because the connecting ends and the lifting frame body 259 are movably connected, the transverse movement in the arc movement can be offset and the lifting frame body 259 is driven only to move in a longitudinal direction.

In one specific embodiment of the present invention, the connecting end of each of the switch keys 252 is symmetrically fixed with two sliding bulges 10 perpendicular to the axial direction of the main cover 22, the lifting frame body 259 is provided with four chutes 11 corresponding to the four sliding bulges 10 on the frame body, and the four sliding bulges 10 are correspondingly slidably connected in the four chutes 11.

The sliding bulges 10 can slide in the chutes 11 along a transverse direction, which can offset the transverse movement of the sliding bulges 10 in the arc movement without hindering the movement of the sliding bulges 10; and the longitudinal movement of the sliding bulges 10 in the arc movement can extrude the inner walls of the chutes 11 and drive the lifting frame body 259 to move along the longitudinal direction.

Preferably, the four chutes 11 are formed at both ends of the zigzag brackets respectively.

In one specific embodiment of the present invention, an annular groove 223 is arranged on the circumferential side of the main cover 22, the sealing ring 23 is sleeved and fixed on the annular groove 223, and the outer circumferential side of the sealing ring 23 can extend from the annular groove 223 to seal the annular gap 3.

The annular groove 223 can conveniently fix the sealing ring 23.

The above only describes preferred embodiments of the present invention and is not intended to limit the present invention. Any modification, equivalent replacement, improvement, etc. made within the spirit and the principle of the present invention shall be included within the protection scope of the present invention.

What is claimed is:

1. A storage tank, comprising a tank body (1) and a sealing cover (2), wherein a top of the tank body (1) is provided with a tank mouth; the sealing cover (2) can seal the tank mouth, wherein the sealing cover (2) comprises a main cover (22), a cover plate (21), a sealing ring (23), an annular extrusion part (24) and a sealing switch (25);

a top of the main cover (22) is provided with an accommodating groove (221); the cover plate (21) is covered on the accommodating groove (221) and is provided with operation ports (211) corresponding to the sealing switch (25); an edge of the cover plate (21) covers the tank mouth; a sealable annular gap (3) is formed between an outer circumference of the main cover (22) and an inner wall of the tank body (1); the sealing ring (23) is sleeved and fixed on the outer circumference of the main cover (22); the annular extrusion part (24) is slidably sleeved on the main cover (22) below the sealing ring (23) to extrude or release the sealing ring (23) to change a shape for opening or sealing the annular gap (3); the sealing switch (25) is located in the accommodating groove (221); an upper end of the sealing switch is a driving end and corresponds to the operation ports (211), and a lower end is an installing end and is fixedly connected with the annular extrusion part (24);

wherein the sealing switch (25) comprises a guide column (254), a compression spring (253), a lifting frame (251), two switch keys (252) and a connecting column (255); the guide column (254) is fixed at the bottom of the cover plate (21) along a sliding direction of the annular extrusion part (24); the lifting frame (251) is slidably connected to the guide column (254); and the compression spring (253) is sleeved on the guide column (254), and both ends are fixedly connected with the bottom of the cover plate (21) and the lifting frame (251) respectively;

the two switch keys (252) are symmetrically and rotatably connected to the main cover (22) and have a lifting gap (4) therebetween for accommodating the lifting frame (251); two operation ports (211) are arranged, and the driving ends of the two switch keys (252) correspond to the operation ports (211) and connecting ends are movably connected with the lifting frame (251); and the upper end of the connecting column (255) is fixed on the lifting frame (251);

the bottom of the accommodating groove (221) is provided with a perforated hole (5) corresponding to the connecting column (255), the lower end of the connecting column (255) is the installing end, and the installing end penetrates through the perforated hole (5) and is fixedly connected with the annular extrusion part (24).

2. The storage tank according to claim 1, wherein the annular extrusion part (24) comprises an extrusion ring (241) and a connecting frame (242); the connecting frame (242) is fixed on the inner wall of the extrusion ring (241); the lower end of the connecting column (255) is fixedly connected with the connecting frame (242); the bottom lower end surface of the main cover (22) is provided with a groove (222) for the connecting frame (242) to slide up and down; and the extrusion ring (241) is slidably sleeved on the main cover (22).

3. The storage tank according to claim 2, wherein the connecting frame (242) is an I-shaped frame, and the groove (222) is correspondingly matched with the I-shaped frame.

4. The storage tank according to claim 1, wherein the lifting frame (251) comprises a lifting frame body (259) and a connecting piece (256); the connecting piece (256) is a disc; the disc is fixed on the lifting frame body (259); the connecting column (255) is coaxially fixed at the bottom of the disc; the guide column (254) and the connecting column (255) are coaxially arranged; the disc and the connecting column (255) are provided with guide holes (6) corresponding to the guide column (254); the guide column (254) is slidably connected into the guide holes (6); and the connecting ends of the switch keys (252) are movably connected with the lifting frame body (259).

5. The storage tank according to claim 4, wherein the sealing switch (25) further comprises a sealing gasket (257), the sealing gasket (257) is provided with an installing hole (7) corresponding to the connecting column (255), and the sealing gasket (257) is sleeved on the connecting column (255) for sealing the perforated hole (5).

6. The storage tank according to claim 4, wherein the sealing switch (25) further comprises four connecting plates (258); the four connecting plates (258) are fixed at the bottom of the cover plate (21), located on both sides of the two switch keys (252), and arranged symmetrically; connection bulges (8) are symmetrically fixed on two side surfaces of the two switch keys (252); the four connecting plates (258) are provided with connecting holes (9); the four connecting bulges (8) are correspondingly rotatably connected to the four connecting holes (9); and the driving ends of the two switch keys (252) are kneaded to rotate with the connecting bulges (8) as axes to drive the connecting ends to rise and then drive the lifting frame body (259) to rise.

7. The storage tank according to claim 6, wherein the connecting end of each of the switch keys (252) is symmetrically fixed with two sliding bulges (10) perpendicular to the axial direction of the main cover (22), the lifting frame body (259) is provided with four chutes (11) corresponding to the four sliding bulges (10) on the frame body, and the four sliding bulges (10) are correspondingly slidably connected in the four chutes (11).

8. The storage tank according to claim 1, wherein an annular groove (223) is arranged on the circumferential side of the main cover (22), the sealing ring (23) is sleeved and fixed on the annular groove (223), and the outer circumferential side of the sealing ring (23) can extend from the annular groove (223) to seal the annular gap (3).

* * * * *